US007696144B2

(12) United States Patent
Dodd

(10) Patent No.: US 7,696,144 B2
(45) Date of Patent: Apr. 13, 2010

(54) PARTICULATE TEXTILE TREATMENT COMPOSITION COMPRISING SILICONE, CLAY AND ANIONIC SURFACTANT

(75) Inventor: Malcolm McClaren Dodd, Tyne & Wear (GB)

(73) Assignee: The Procter & Gamble Co., Cincinnati, OH (US)

( * ) Notice: Subject to any disclaimer, the term of this patent is extended or adjusted under 35 U.S.C. 154(b) by 573 days.

(21) Appl. No.: 11/500,184

(22) Filed: Aug. 7, 2006

(65) Prior Publication Data

US 2007/0028392 A1 Feb. 8, 2007

(30) Foreign Application Priority Data

Aug. 5, 2005 (EP) ..... 05254887

(51) Int. Cl.
*C11D 17/06* (2006.01)
*C11D 3/12* (2006.01)

(52) U.S. Cl. ..... 510/276; 510/349; 510/351; 510/400; 510/438; 510/443; 510/444; 510/451; 510/452; 510/466; 510/507; 510/511

(58) Field of Classification Search ..... 510/276, 510/349, 351, 400, 438, 443, 444, 451, 507, 510/452, 466, 511
See application file for complete search history.

(56) References Cited

U.S. PATENT DOCUMENTS

| | | | |
|---|---|---|---|
| 4,062,647 | A | 12/1977 | Storm et al. |
| 4,419,250 | A | 12/1983 | Allen et al. |
| 4,421,657 | A | 12/1983 | Allen et al. |
| 4,482,477 | A | 11/1984 | Allen et al. |
| 4,585,563 | A | 4/1986 | Busch et al. |
| 4,885,101 | A | 12/1989 | Tai |
| 5,277,968 | A | 1/1994 | Canivenc |
| 6,656,901 | B2 | 12/2003 | Moorfield et al. |
| 2003/0139309 | A1 | 7/2003 | Brockett et al. |
| 2005/0170995 | A1 | 8/2005 | Blyth et al. |
| 2005/0170996 | A1 | 8/2005 | Blyth et al. |
| 2005/0170997 | A1 | 8/2005 | Blyth et al. |
| 2007/0028391 | A1 | 2/2007 | Dodd et al. |
| 2007/0028393 | A1 | 2/2007 | Blyth et al. |

FOREIGN PATENT DOCUMENTS

| | | | |
|---|---|---|---|
| EP | 0 163 352 | A2 | 12/1985 |
| EP | 0 299 575 | A1 | 1/1989 |
| EP | 0 381 487 | A1 | 8/1990 |
| EP | 0 483 411 | A1 | 5/1992 |
| EP | 1026229 | A1 | 8/2000 |
| EP | 1 561 802 | A1 | 8/2005 |
| GB | 2 138 037 | A | 10/1984 |
| WO | WO 92/07927 | A1 | 5/1992 |
| WO | WO 02/092748 | A1 | 11/2002 |

OTHER PUBLICATIONS

PCT International Search Report, dated Jan. 24, 2007, 7 pages.

*Primary Examiner*—Lorna M Douyon
(74) *Attorney, Agent, or Firm*—Gary J. Foose; Ronald Terk Sia; Mark A. Charles

(57) ABSTRACT

The present invention relates to a particulate textile treatment composition comprising silicone, clay and anionic surfactant, wherein the composition comprises at least three particulate components: wherein the first particulate component comprises silicone, clay and a first anionic surfactant; wherein the second particulate component comprises a second anionic surfactant; and wherein the third particulate component comprises a third anionic surfactant; wherein the concentration of the second anionic surfactant in the second particulate component is greater than the concentration of the third anionic surfactant in the third particulate component.

10 Claims, No Drawings

PARTICULATE TEXTILE TREATMENT COMPOSITION COMPRISING SILICONE, CLAY AND ANIONIC SURFACTANT

TECHNICAL FIELD

The present invention relates to a particulate textile treatment composition, such as a particulate laundry detergent composition, that is capable of imparting a fabric-softness benefit onto a fabric. The textile treatment composition comprises silicone, clay and anionic surfactant.

BACKGROUND

Laundry detergent compositions that both clean and soften fabric during a laundering process are known and have been developed and sold by laundry detergent manufacturers for many years. Typically, these laundry detergent compositions comprise components that are capable of providing a fabric-softening benefit to the laundered fabric; these fabric-softening components include clays and silicones.

The incorporation of clay into laundry detergent compositions to impart a fabric-softening benefit to the laundered fabric is described in the following references. A granular, built laundry detergent composition comprising a smectite clay that is capable of both cleaning and softening a fabric during a laundering process is described in U.S. Pat. No. 4,062,647 (Storm, T. D., and Nirschl, J. P.; The Procter & Gamble Company). A heavy duty fabric-softening detergent comprising bentonite clay agglomerates is described in GB 2 138 037 (Allen, E., Coutureau, M., and Dillarstone, A.; Colgate-Palmolive Company). Laundry detergent compositions containing fabric-softening clays of between 150 and 2,000 microns in size are described in U.S. Pat. No. 4,885,101 (Tai, H. T.; Lever Brothers Company).

The fabric-softening performance of clay-containing laundry detergent compositions is improved by the incorporation of a flocculant to the clay-containing laundry detergent composition. For example, a detergent composition comprising a smectite type clay and a polymeric clay-flocculating agent is described in EP 0 299 575 (Raemdonck, H., and Busch, A.; The Procter & Gamble Company).

The use of silicones to provide a fabric-softening benefit to laundered fabric during a laundering process is also known. U.S. Pat. No. 4,585,563 (Busch, A., and Kosmas, S.; The Procter & Gamble Company) describes that specific organofunctional polydialkylsiloxanes can advantageously be incorporated in granular detergents to provide remarkable benefits inclusive of through-the-wash softening and further textile handling improvements. U.S. Pat. No. 5,277,968 (Canivenc, E.; Rhone-Poulenc Chemie) describes a process for the conditioning of textile substrates to allegedly impart a pleasant feel and good hydrophobicity thereto, comprising treating such textile substances with an effective conditioning amount of a specific polydiorganosiloxane.

Detergent Manufacturers have attempted to incorporate both clay and silicone in the same laundry detergent composition. For example, siliconates were incorporated in clay-containing compositions to allegedly improve their dispensing performance. U.S. Pat. No. 4,419,250 (Allen, E., Dillarstone, R., and Reul, J. A.; Colgate-Palmolive Company) describes agglomerated bentonite particles that comprise a salt of a lower alkyl siliconic acid and/or a polymerization product(s) thereof. U.S. Pat. No. 4,421,657 (Allen, E., Dillarstone, R., and Reul, J. A.; Colgate-Palmolive Company) describes a particulate heavy-duty laundering and textile-softening composition comprising bentonite clay and a siliconate. U.S. Pat. No. 4,482,477 (Allen, E., Dillarstone, R., and Reul, J. A.; Colgate-Palmolive Company) describes a particulate built synthetic organic detergent composition which includes a dispensing assisting proportion of a siliconate and preferably bentonite as a fabric-softening agent. In another example, EP 0 163 352 (York, D. W.; The Procter & Gamble Company) describes the incorporation of silicone into a clay-containing laundry detergent composition in an attempt to control the excessive suds that are generated by the clay-containing laundry detergent composition during the laundering process. EP 0 381 487 (Biggin, I. S., and Cartwright, P. S.; BP Chemicals Limited) describes an aqueous based liquid detergent formulation comprising clay that is pre-treated with a barrier material such as a polysiloxane.

Detergent manufacturers have also attempted to incorporate a silicone, clay and a flocculant in a laundry detergent composition. For example, a fabric treatment composition comprising substituted polysiloxanes, softening clay and a clay flocculant is described in WO92/07927 (Marteleur, C. A. A. V. J., and Convents, A. C.; The Procter & Gamble Company).

More recently, fabric care compositions comprising an organophilic clay and functionalised oil are described in U.S. Pat. No. 6,656,901 B2 (Moorfield, D., and Whilton, N.; Unilever Home & Personal Care USA division of Conopco, Inc.). WO02/092748 (Instone, T. et al; Unilever PLC) describes a granular composition comprising an intimate blend of a non-ionic surfactant and a water-insoluble liquid, which may a silicone, and a granular carrier material, which may be a clay. WO03/055966 (Cocardo, D. M., et al; Hindustain Lever Limited) describes a fabric care composition comprising a solid carrier, which may be a clay, and an anti-wrinkle agent, which may be a silicone.

The Inventors have found that the optimal balance of fabric-softness performance to good physical property profile of particulate textile treatment compositions that comprise silicone, clay and anionic surfactant occurs when a specific anionic surfactant concentration gradient exists across the population of particles that make up the textile treatment composition.

SUMMARY

The present invention provides a particulate textile treatment composition comprising silicone, clay and anionic surfactant, wherein the composition comprises at least three particulate components: wherein the first particulate component comprises silicone, clay and a first anionic surfactant; wherein the second particulate component comprises a second anionic surfactant; and wherein the third particulate component comprises a third anionic surfactant; wherein the concentration of the second anionic surfactant in the second particulate component is greater than the concentration of the third anionic surfactant in the third particulate component.

DESCRIPTION

Textile Treatment Composition

The textile treatment composition comprises at least three particulate components. By at least three particulate components it is typically meant that the composition is made of up of at least three separate and different types of particles that are physically and chemical distinct from each other. The first particulate component, the second particulate component and the third separate component are described in more detail below.

Preferably the textile treatment composition comprises from 4%, or from 6%, or from 8%, and preferably to 20%, or to 15%, or to 12%, by weight of the textile treatment composition, of the first particulate component. Preferably, the composition comprises from 1%, or from 2%, or from 5%, and preferably to 25%, or to 20%, or to 15%, or to 10%, by weight of the textile treatment composition, of the second particulate component. Preferably the textile treatment composition comprises from 20%, or from 30%, or from 40%, or from 50%, and preferably to 90%, or to 80%, or to 70%, or to 60%, by weight of the textile treatment composition, of the third particulate component.

The textile treatment composition comprises clay, silicone, an anionic surfactant, preferably a flocculant and optionally adjunct ingredients such as bleach and/or builder. These ingredients are described in more detail below.

The textile treatment composition preferably comprises at least 4%, or at least 6%, or at least 8%, or at least 10%, or at least 12%, by weight of the textile treatment composition, of clay. The textile treatment composition preferably comprises at least 4%, or at least 6%, or at least 8%, or at least 10%, or at least 12%, by weight of the textile treatment composition, of anionic surfactant.

The concentration of the second anionic surfactant in the second particulate component is greater than the concentration of the third anionic surfactant in the third particulate component. Preferably, the concentration of the third anionic surfactant in the third particulate component is greater than the concentration of the first anionic surfactant in the first particulate component. Preferably, the ratio of the concentration of the second anionic surfactant in the second particulate component to the concentration of the third anionic surfactant in the third particulate component is in the range of from greater than 1:1 to 100:1, preferably from 2:1, or from 3:1, and preferably to 75:1, or to 50:1, or to 25:1, or to 15:1, or to 10:1, or to 5:1. Preferably, the ratio of the weight of third anionic surfactant present in the composition to the weight of second anionic surfactant present in the composition is in the range of from greater than 1:1 to 100:1, preferably from 1.5:1, or from 2:1, or from 2.5:1, and preferably to 50:1, or to 25:1, or to 15:1, or to 10:1, or to 5:1. Preferably, the ratio of the weight of third particulate component present in the composition to the weight of second particulate component present in the composition is in the range of from greater than 1:1 to 50:1, or from 2:1, or from 4:1, or from 6:1, or from 8:1, and preferably to 40:1, or to 30:1, or to 20:1, or to 10:1. Without wishing to be bound by theory, it is believed that these specific concentrations, amounts and ratios of anionic surfactant and particulate components ensure an optimal balance of fabric-softness performance to a good physical property profile of the particulate textile treatment composition.

The textile treatment composition is in particulate form, preferably in free-flowing particulate form. The textile treatment composition can be in the form of an agglomerate, granule, flake, extrudate, bar, tablet or any combination thereof. The textile treatment composition can be made by methods such as dry-mixing, agglomerating, compaction, spray drying, pan-granulation, spheronization or any combination thereof. The textile treatment composition preferably has a bulk density of from 300 g/l to 1,500 g/l, preferably from 500 g/l to 1,000 g/l.

The textile treatment composition may in unit dose form, including not only tablets, but also unit dose pouches wherein the textile treatment composition is at least partially enclosed, preferably completely enclosed, by a film such as a polyvinyl alcohol film.

The textile treatment composition is typically capable of both cleaning and softening fabric during a laundering process. Typically, the textile treatment composition is a laundry detergent composition that is formulated for use in an automatic washing machine, although it can also be formulated for hand-washing use.

The following adjunct ingredients and levels thereof, when incorporated into the textile treatment composition, further improve the fabric-softening performance and fabric-cleaning performance of the textile treatment composition: at least 8%, or at least 9%, or at least 10%, by weight of the textile treatment composition, of alkyl benzene sulphonate detersive surfactant; at least 0.5%, or at least 1%, or even at least 2%, by weight of the textile treatment composition, of a cationic quaternary ammonium detersive surfactant; at least 1%, by weight of the textile treatment composition, of an alkoxylated alkyl sulphate detersive surfactant, preferably ethoxylated alkyl sulphate detersive surfactant; less than 12% or even less than 6%, or even 0%, by weight of the textile treatment composition, of a zeolite builder; and any combination thereof. Preferably the textile treatment composition comprises at least 0.3%, by weight of the textile treatment composition, of a flocculant. The weight ratio of clay to flocculent in the textile treatment composition is preferably in the range of from 10:1 to 200:1, preferably from 14:1 to 160:1 more preferably from 20:1 to 100:1 and more preferably from 50:1 to 80:1.

First Particulate Component

The first particulate component forms part of the textile treatment composition. The first particulate component comprises silicone, clay, a first anionic surfactant and optionally adjunct ingredients.

Preferably the first particulate component comprises from 10%, or from 25%, or from 50%, or from 70%, and preferably to 95%, or to 90%, by weight of the first particulate component, of clay. Preferably the first particulate component comprises from 1%, or from 2%, or from 3%, or from 4%, or from 5%, and preferably to 25%, or to 20%, or to 15%, or to 13%, or to 12%, or to 10%, by weight of the first particulate component, of silicone. Preferably the weight ratio of the clay to the silicone that are present in the first particulate component is in the range of from 1:1, or from 2:1, or from 3:1, or from 4:1, or from 5:1, or from 6:1, or from 7:1, and preferably to less than 100:1, or to 50:1, or to 25:1, or to 20:1, or to 15:1. Without wishing to be bound by theory, these preferred levels and ratios of clay and silicone are believed to ensure good physical characteristics and good flowability of the first particulate component and the textile treatment composition.

Preferably, the first particulate component comprises from 1% or from 2%, and preferably to 10%, or to 8%, or to 6%, by weight of the first particulate component, of first anionic surfactant.

The first particulate component is typically in the form of a free-flowing powder, such as an agglomerate, an extrudate, a spray-dried powder, a needle, a noodle, a flake or any combination thereof. Most preferably, the first particulate component is in the form of an agglomerate.

Second Particulate Component

The second particulate component forms part of the textile treatment composition. The second particulate component comprises a second anionic surfactant. Preferably the second particulate component comprises from 15%, or from 20%, or from 25%, or from 30%, or from 35%, or from 40%, and preferably to 80%, or to 70%, or to 60%, or to 50%, by weight of the second particulate component, of second anionic surfactant. The second particulate component preferably comprises from 15%, or from 20%, or from 25%, or from 30%, and preferably to 55%, or to 45%, by weight of the second particulate component, of builder, preferably zeolite. The second particulate component preferably comprises from 5% to 25% sodium carbonate.

The second particulate component is typically in the form of a free-flowing powder, such as an agglomerate, an extrudate, a spray-dried powder, a needle, a noodle, a flake or any combination thereof. Most preferably, the second particulate component is in the form of an agglomerate or an extrudate, most preferably an agglomerate.

Third Particulate Component

The third particulate component forms part of the textile treatment composition. The third particulate component comprises a third anionic surfactant. Preferably the third particulate component comprises from 1%, or from 2.5%, or from 5%, or from 7.5%, or from 10%, or from 12.5%, and preferably to 50%, or to 40%, or to 30%, or to less than 25%, or to 20%, or to 15%, by weight of the third particulate component, of third anionic surfactant. The third particulate component preferably comprises from 1%, or from 2.5%, or from 5%, or from 7.5%, or from 10%, and preferably to 50%, or to 40%, or to 30%, or to 20%, or to 15%, by weight of the third particulate component, of builder, preferably zeolite. The third particulate component preferably comprises from 5% to 40%, preferably from 10% to 30%, by weight of the third particulate component, of sodium carbonate.

The third particulate component is typically in the form of a free-flowing powder, such as an agglomerate, an extrudate, a spray-dried powder, a needle, a noodle, a flake or any combination thereof. Most preferably, the third particulate component is in the form of a spray-dried powder.

Clay

Typically, preferred clays are fabric-softening clay such as smectite clay. Preferred smectite clays are beidellite clays, hectorite clays, laponite clays, montmorillonite clays, nontonite clays, saponite clays and mixtures thereof. Preferably, the smectite clay is a dioctahedral smectite clay, more preferably a montmorillonite clay. Dioctrahedral smectite clays typically have one of the following two general formulae:

$$Na_xAl_{2-x}Mg_xSi_4O_{10}(OH)_2 \qquad \text{Formula (I)}$$

or $$Ca_xAl_{2-x}Mg_xSi_4O_{10}(OH)_2 \qquad \text{Formula (II)}$$

wherein x is a number from 0.1 to 0.5, preferably from 0.2 to 0.4.

Preferred clays are low charge montmorillonite clays (also known as a sodium montmorillonite clay or Wyoming type montmorillonite clay) which have a general formula corresponding to formula (I) above. Preferred clays are also high charge montmorillonite clays (also known as a calcium montmorillonite clay or Cheto type montmorillonite clay) which have a general formula corresponding to formula (HI) above. Preferred clays are supplied under the tradenames: Fulasoft 1 by Arcillas Activadas Andinas; White Bentonite STP by Fordamin; and Detercal P7 by Laviosa Chemica Mineraria SPA.

The clay may be a hectorite clay. Typical hectorite clay has the general formula:

$$[(Mg_{3-x}Li_x)Si_{4-y}Me_y^{III}O_{10}(OH_{2-z}F_z)]^{-(x+y)}((x+y)/n)\ M^{n+} \qquad \text{Formula (III)}$$

wherein y=0 to 0.4, if y=>0 then $Me^{III}$ is Al, Fe or B, preferably y=0; $M^{n+}$ is a monovalent (n=1) or a divalent (n=2) metal ion, preferably selected from Na, K, Mg, Ca and Sr. x is a number from 0.1 to 0.5, preferably from 0.2 to 0.4, more preferably from 0.25 to 0.35. z is a number from 0 to 2. The value of (x+y) is the layer charge of the clay, preferably the value of (x+y) is in the range of from 0.1 to 0.5, preferably from 0.2 to 0.4, more preferably from 0.25 to 0.35. A preferred hectorite clay is that supplied by Rheox under the tradename Bentone HC. Other preferred hectorite clays for use herein are those hectorite clays supplied by CSM Materials under the tradename Hectorite U and Hectorite R, respectively.

The clay may also be selected from the group consisting of: allophane clays; chlorite clays, preferred chlorite clays are amesite clays, baileychlore clays, chamosite clays, clinochlore clays, cookeite clays, corundophite clays, daphnite clays, delessite clays, gonyerite clays, nimite clays, odinite clays, orthochamosite clays, pannantite clays, penninite clays, rhipidolite clays, sudoite clays and thuringite clays; illite clays; inter-stratified clays; iron oxyhydroxide clays, preferred iron oxyhydroxide clays are hematite clays, goethite clays, lepidocrite clays and ferrihydrite clays; kaolin clays, preferred kaolin clays are kaolinite clays, halloysite clays, dickite clays, nacrite clays and hisingerite clays; smectite clays; vermiculite clays; and mixtures thereof.

The clay may also be a light coloured crystalline clay mineral, preferably having a reflectance of at least 60, more preferably at least 70, or at least 80 at a wavelength of 460 nm. Preferred light coloured crystalline clay minerals are china clays, halloysite clays, dioctahedral clays such as kaolinite, trioctahedral clays such as antigorite and amesite, smectite and hormite clays such as bentonite (montmorillonite), beidilite, nontronite, hectorite, attapulgite, pimelite, mica, muscovite and vermiculite clays, as well as pyrophyllite/talc, willemseite and minnesotaite clays. Preferred light coloured crystalline clay minerals are described in GB2357523A and WO01/44425.

Preferred clays have a cationic exchange capacity of at least 70 meq/100 g. The cationic exchange capacity of clays can be measured using the method described in Grimshaw, The Chemistry and Physics of Clays, Interscience Publishers, Inc., pp. 264-265 (1971).

Preferably, the clay has a weight average primary particle size, typically of greater than 20 micrometers, preferably more than 23 micrometers, preferably more than 25 micrometers, or preferably from 21 micrometers to 60 micrometers, more preferably from 22 micrometers to 50 micrometers, more preferably from 23 micrometers to 40 micrometers, more preferably from 24 micrometers to 30 micrometers, more preferably from 25 micrometers to 28 micrometers. Clays having these preferred weight average primary particle sizes provide a further improved fabric-softening benefit. The method for determining the weight average particle size of the clay is described in more detail hereinafter.

Method For Determining The Weight Average Primary Particle Size Of The Clay:

The weight average primary particle size of the clay is typically determined using the following method: 12 g clay is placed in a glass beaker containing 250 ml distilled water and vigorously stirred for 5 minutes to form a clay suspension. The clay is not sonicated, or microfluidised in a high pressure microfluidizer processor, but is added to said beaker of water in an unprocessed form (i.e. in its raw form). 1 ml clay suspension is added to the reservoir volume of an Accusizer 780 single-particle optical sizer (SPOS) using a micropipette. The clay suspension that is added to the reservoir volume of said Accusizer 780 SPOS is diluted in more distilled water to form a diluted clay suspension; this dilution occurs in the reservoir volume of said Accusizer 780 SPOS and is an automated process that is controlled by said Accusizer 780 SPOS, which determines the optimum concentration of said diluted clay suspension for determining the weight average particle size of the clay particles in the diluted clay suspension. The diluted clay suspension is left in the reservoir volume of said Accusizer 780 SPOS for 3 minutes. The clay suspension is vigorously stirred for the whole period of time that it is in the reservoir volume of said Accusizer 780 SPOS. The diluted clay suspension is then sucked through the sensors of said Accusizer 780 SPOS; this is an automated process that is controlled by said Accusizer 780 SPOS, which determines the optimum flow rate of the diluted clay suspension through the sensors for determining the weight average particle size of the clay particles in the diluted clay suspension. All of the steps of this method are carried out at a temperature of 20° C. This method is carried out in triplicate and the mean of these results determined.

Silicone

The silicone is preferably a fabric-softening silicone. The silicone typically has the general formula:

Formula (IV)

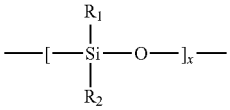

wherein, each $R_1$ and $R_2$ in each repeating unit, —(Si($R_1$)($R_2$)O)—, are independently selected from branched or unbranched, substituted or unsubstituted $C_1$-$C_{10}$ alkyl or alkenyl, substituted or unsubstituted phenyl, or units of -[—$R_1R_2$Si—O—]-; x is a number from 50 to 300,000, preferably from 100 to 100,000, more preferably from 200 to 50,000; wherein, the substituted alkyl, alkenyl or phenyl are typically substituted with halogen, amino, hydroxyl groups, quaternary ammonium groups, polyalkoxy groups, carboxyl groups, or nitro groups; and wherein the polymer is terminated by a hydroxyl group, hydrogen or —$SiR_3$, wherein, $R_3$ is hydroxyl, hydrogen, methyl or a functional group.

Suitable silicones include: amino-silicones, such as those described in EP150872, WO92/01773 and U.S. Pat. No. 4,800,026; quaternary-silicones, such as those described in U.S. Pat. No. 4,448,810 and EP459821; high-viscosity silicones, such as those described in WO00/71806 and WO00/71807; modified polydimethylsiloxane; functionalized polydimethyl siloxane such as those described in U.S. Pat. No. 5,668,102. Preferably, the silicone is a polydimethylsiloxane.

The silicone may preferably be a silicone mixture of two or more different types of silicone. Preferred silicone mixtures are those comprising: a high-viscosity silicone and a low viscosity silicone; a functionalised silicone and a non-functionalised silicone; or a non-charged silicone polymer and a cationic silicone polymer.

The silicone typically has a viscosity, of from 5,000 cP to 5,000,000 cP, or from greater than 10,000 cP to 1,000,000 cP, or from 10,000 cP to 600,000 cP, more preferably from 50,000 cP to 400,000 cP, and more preferably from 80,000 cP to 200,000 cP when measured at a shear rate of $20s^{-1}$ and at ambient conditions (20° C. and 1 atmosphere). The silicone is typically in a liquid or liquefiable form, especially when admixed with the clay. Typically, the silicone is a polymeric silicone comprising more than 3, preferably more than 5 or even more than 10 siloxane monomer units.

Anionic Surfactant

The textile treatment composition comprises an anionic surfactant. The first anionic surfactant, second anionic surfactant and third anionic surfactant can be same type of anionic surfactant or different types of anionic surfactant. Preferably two or more, preferably all three, of the first, second and third anionic surfactants are the same type of anionic surfactant, preferably alkyl benzene sulphonate. Preferably the first, second and third anionic surfactant are each separately and independently selected from the group consisting of: linear or branched, substituted or unsubstituted $C_{8-18}$ alkyl sulphates; linear or branched, substituted or unsubstituted $C_{8-18}$ alkyl ethoxylated sulphates having an average degree of ethoxylation of from 1 to 20; linear or branched, substituted or unsubstituted $C_{8-18}$ linear alkylbenzene sulphonates; linear or branched, substituted or unsubstituted $C_{12-18}$ alkyl carboxylic acids; Most preferred are anionic surfactants selected from the group consisting of: linear or branched, substituted or unsubstituted $C_{8-18}$ alkyl sulphates; linear or branched, substituted or unsubstituted $C_{8-18}$ linear alkylbenzene sulphonates; and mixtures thereof. The textile treatment composition preferably comprises at least 1%, or at least 2.5%, or at least 5% and to 25%, or to 15%, or to 10%, by weight of the textile treatment composition, of an anionic detersive surfactant.

Adjunct Components

The auxiliary composition and/or the textile treatment composition may optionally comprise one or more adjunct components. These adjunct components are typically selected from the group consisting of: surfactants such as anionic surfactants, non-ionic surfactants, cationic surfactants and zwitterionic surfactants; builders such as zeolite and polymeric co-builders such as polymeric carboxylates; bleach such as percarbonate, typically in combination with bleach activators, bleach boosters and/or bleach catalysts; chelants; enzymes such as proteases, lipases and amylases; anti-redeposition polymers; soil-release polymers; polymeric soil-dispersing and/or soil-suspending agents; dye-transfer inhibitors; fabric-integrity agents; fluorescent whitening agents; suds suppressors; additional fabric-softeners such as cationic quaternary ammonium fabric-softening agents; flocculants; and combinations thereof.

Preferred flocculants include polymers comprising monomer units selected from the group consisting of ethylene oxide, acrylamide, acrylic acid and mixtures thereof. Preferably the flocculating aid is a polyethyleneoxide. Typically the flocculating aid has a molecular weight of at least 100,000 Da, preferably from 150,000 Da to 5,000,000 Da and most preferably from 200,000 Da to 700,000 Da.

EXAMPLES

Example 1

A Process for Preparing a Silicone Emulsion by Batch Mixing 10.0 g of 45 w/w % aqueous $C_{11-13}$ alkylbenzene sulphonate (LAS) paste and 10.0 g water are added to a beaker and gently mixed, to avoid foaming, until a homogeneous paste is formed. 80.0 g of polydimethylsiloxane (silicone) having a viscosity of 100,000 cP at ambient temperature, is then added to the beaker on top of the LAS/water paste. The silicone, LAS and water are mixed thoroughly by hand using a flat knife for 2 minutes to form an emulsion.

Example 2

A Process for Preparing a Silicone Emulsion by Batch Mixing

A silicone emulsion suitable for use in the present invention is prepared according to the method of example 1, but the emulsion comprises 15.0 g of 30 w/w % aqueous $C_{1-13}$ alkylbenzene sulphonate (LAS) paste, 5.0 g water and 80.0 g of polydimethylsiloxane (silicone).

Example 3

A Process for Preparing a Silicone Emulsion by Batch Mixing

A silicone emulsion suitable for use in the present invention is prepared according to the method of example 1, but the emulsion comprises 9.1 g of 30 w/w % aqueous $C_{1-3}$ alkylbenzene sulphonate (LAS) paste and 90.9 g of polydimethylsiloxane (silicone).

Example 4

A Process for Preparing a Silicone Emulsion by Batch Mixing 20.0 kg of 45 w/w % aqueous $C_{1-13}$ alkylbenzene sulphonate (LAS) paste and 20.0 kg water are added to a batch mixing vessel with a large diameter slow moving agitator (10-60 rpm), and gently mixed, to avoid foaming, until a homogeneous paste is formed. 160.0 kg of polydimethylsiloxane (silicone) having a viscosity of 100,000 cP at ambient temperature, is then added slowly to the vessel on top of the paste while agitating. The silicone, LAS and water are mixed thoroughly for 1-2 hours to form an emulsion.

Example 5

A Process for Preparing a Silicone Emulsion Via Continuous Mixing Process

Polydimethylsiloxane (silicone) having a viscosity of 100,000 cP, 45 w/w % aqueous $C_{1-13}$ alkylbenzene sulphonate (LAS) paste and water are dosed via suitable pumps and flowmeters into a dynamic mixer (such as an IKA DR5 or similar) at the following rates, silicone 290 kg/h, LAS paste 35 kg/h, water 35 kg/h. Material temperatures are between 20-30 degrees centigrade. The mixing head is rotated at a tip speed of 23 m/s. The material exiting the mixer is a homogeneous emulsion.

Example 6

A Process for Making a Clay/Silicone Agglomerate 536 g of bentonite clay is added to a Braun mixer. 67 g of the emulsion of any of examples 1-5 is added to the Braun mixer, and the ingredients in the mixer are mixed for 10 seconds at 1,100 rpm (speed setting 8). 53 g of 45 w/w % aqueous $C_{11-13}$ alkylbenzene sulphonate (LAS) paste is then poured into the mixer over a period of 20-30 seconds while mixing continues. The speed of the Braun mixer is then increased to 2,000 rpm (speed setting 14) and 44 g water is added slowly to the Braun mixer. The mixer is kept at 2,000 rpm for 30 seconds so that wet agglomerates are formed. The wet agglomerates are transferred to a fluid bed dried and dried for 4 minutes at 140° C. to form dry agglomerates. The dry agglomerates are sieved to remove agglomerates having a particle size greater than 1,400 micrometers and agglomerates having a particle size of less than 250 micrometers.

Example 7

A Process for Making a Clay/Silicone Agglomerate Via Continuous Mixing Process

Bentonite clay is dosed via suitable feeder (e.g. a Brabender Loss In Weight feeder, LIW) at a rate of 575 kg/h into a high speed mixer (e.g. a CB 30 Lodige) running at a speed of 1600-1800 rpm. Emulsion prepared according to any of examples 1-5 is dosed into the mixer at a rate of 71 kg/h, along with 56 kg/h of 45 w/w % aqueous $C_{11-13}$ alkylbenzene sulphonate (LAS) paste and 48 kg/h water. The wet particles that form exit the high speed mixer and feed into a low shear mixer (e.g. a KM 600 Lodige) running at a speed of 140 rpm. The mixing action and residence time grow the particles into agglomerates with a particle size range of 150-2000 micrometers. The agglomerates from the low shear mixer enter a fluid bed with inlet air temperature of 145 degrees centigrade to dry off the excess moisture, before passing into a second fluid bed with inlet air temperature of 10 degrees centigrade to cool down the agglomerates. Fine particles of 150-300 micrometer particle size, equivalent to 25% of the total raw material feed rate are elutriated from the fluid beds and recycled back to the high speed mixer. The product from the second fluid bed is then sieved to remove particles greater than 1180 micrometers, which are recycled back to the first fluid bed after passing through a grinder. The final agglomerates from the end of the process have a 5 w/w % water content, and a particle size range between 200-1400 micrometers.

Example 8

A Process for Making a Clay Agglomerate 547.3 g of bentonite clay is added to a Braun mixer. 25.5 g of glycerine is added by pouring into the Braun mixer over a period of 10-20 seconds, while mixing at 1,100 rpm (speed setting 8). This is followed by 16.9 g of molten paraffin wax (at 70° C.) poured into the mixer over a period of 10-20 seconds while mixing continues. The speed of the Braun mixer is then increased to 2,000 rpm (speed setting 14) and 110 g water is added slowly to the Braun mixer. The mixer is kept at 2,000 rpm for 30 seconds so that wet agglomerates are formed. The wet agglomerates are transferred to a fluid bed dried and dried for 4 minutes at 140° C. to form dry agglomerates. The dry agglomerates are sieved to remove agglomerates having a particle size greater than 1,400 micrometers and agglomerates having a particle size of less than 250 micrometers.

Example 9

A Process for Making a Clay Agglomerate Via Continuous Mixing Process

Bentonite clay is dosed via suitable feeder (e.g. a Brabender Loss In Weight feeder, LIW) at a rate of 7036 kg/h into a high speed mixer (e.g. a CB 75 Lodige) running at a speed of 900-1060 rpm. Glycerine is dosed into the mixer at a rate of 327 kg/h, along with 217 kg/h of paraffin wax at a temperature of 70° C. and 1,419 kg/h water. The wet particles exit the high speed mixer and feed into a low shear mixer (e.g. a KM 4200 Lodige) running at a speed of 80-100 rpm. The mixing action and residence time grow the particles into agglomerates with particle size range of 150-2000 micrometers. The agglomerates from the low shear mixer enter a fluid bed with inlet air temperature of 145-155 degrees centigrade to dry off the excess moisture, before passing into a second fluid bed with inlet air temperature of 5-15 degrees centigrade to cool down the agglomerates. Fines particles of less than 300 micrometer particle size, equivalent to 25% of the total raw material feed rate are elutriated from the fluid beds and recycled back to the high speed mixer. The product from the second fluid bed is then sieved to remove particles greater than 1180 micrometers, which are recycled back to the first fluid bed after passing through a grinder. The final agglomerates from the end of the process have a 3-5 w/w % water content and a particle size range between 200-1400 micrometers.

Example 10

A Process for Making an Anionic Agglomerate

A premix of 78 w/w % aqueous $C_{1-13}$ alkylbenzene sulphonate (LAS) paste and sodium silicate powder is made by mixing the two materials together in a Kenwood orbital blender at maximum speed for 90 seconds. 296 g of zeolite and 75 g of sodium carbonate are added to a Braun mixer. 329 g of the LAS/silicate premix, which is preheated to 50-60° C., is added onto the top of the powders to the Braun mixer with a knife. The Braun mixer is then run at 2,000 rpm (speed setting 14) for a period of 1-2 minutes, or until wet agglomerates form. The wet agglomerates are transferred to a fluid bed dried and dried for 4 minutes at 130° C. to form dry agglomerates. The dry agglomerates are sieved to remove agglomerates having a particle size greater than 1,400 micrometers and agglomerates having a particle size of less than 250 micrometers. The final particle composition comprises: 40.0 wt % $C_{11-13}$ alkylbenzene sulphonate detersive surfactant; 37.6 wt % zeolite; 0.9 wt % sodium silicate; 12.0 wt % sodium carbonate; 9.5 wt % miscellaneous/water.

Example 11

A Process for Making an Anionic Agglomerate Via Continuous Mixing Process

Zeolite is dosed via suitable feeder (e.g. a Brabender Loss In Weight feeder, LIW) at a rate of 3792 kg/h into a high speed mixer (e.g. a CB 75 Lodige) running at a speed of 800-1000 rpm. Sodium carbonate powder is also added simultaneously to the high speed mixer at a rate of 969 kg/h. A premix of 78 w/w % aqueous $C_{11-13}$ alkylbenzene sulphonate (LAS) paste and sodium silicate powder, formed by intimately mixing the two components under shear, is dosed into the mixer at a rate of 4239 kg/h, where it is blended into the powders to form wet particles. The wet particles exit the high speed mixer and feed into a low shear mixer (e.g. a KM 4200 Lodige) running at a speed of 80-100 rpm. The mixing action and residence time grow the particles into agglomerates with particle size range of 150-2000 micrometers. The agglomerates from the low shear mixer enter a fluid bed with an inlet air temperature of 125-135 degrees centigrade to dry off the excess moisture, before passing into a second fluid bed with an inlet air temperature of 5-15 degrees centigrade to cool down the agglomerates. Fines particles of less than 300 micrometer particle size, equivalent to ~25% of the total raw material feed rate are elutriated from the fluid beds and recycled back to the high speed mixer. The product from the second fluid bed is then sieved to remove particles greater than 1180 micrometers, which are recycled back to the first fluid bed (dryer) after passing through a grinder. The final agglomerates from the end of the process have a 5-6 w/w % water content, and a particle size range between 200-1400 micrometers. Final particle composition comprises: 40.0 wt % $C_{11-13}$ alkylbenzene sulphonate detersive surfactant; 37.6 wt % zeolite; 0.9 wt % sodium silicate; 12.0 wt % sodium carbonate; 9.5 wt % miscellaneous/water.

Example 12

A Laundry Detergent Spray Dried Particle

A detergent particle is produced by mixing the liquid and solid components of the formulation with water to form a viscous slurry. The slurry is fed under high pressure through nozzles to give atomisation in a spray drying tower, where the atomised droplets encounter a hot air stream. Water is rapidly evaporated from the droplets giving porous granules which are collected at the base of the tower. The granules are then cooled via an airlift, and screened to remove coarse lumps. A spray dried laundry detergent particle composition suitable for use in the present invention comprises: 12.2 wt % $C_{11-13}$ alkylbenzene sulphonate detersive surfactant; 0.4 wt % polyethylene oxide having a weight average molecular weight of 300,000 Da; 1.6 wt % $C_{12-14}$ alkyl, di-methyl, ethoxy quaternary ammonium detersive surfactant; 11 wt % zeolite A; 20.3 wt % sodium carbonate; 2.1 wt % sodium maleic/acrylic copolymer; 1 wt % soap; 1.3 wt % sodium toluene sulphonate; 0.1 wt % ethylenediamine-N'N-disuccinic acid, (S,S) isomer in the form of a sodium salt; 0.3 wt % 1,1-hydroxyethane diphosphonic acid; 0.6 wt % magnesium sulphate; 42 wt % sulphate; 7.1 wt % miscellaneous/water.

Example 13

A Laundry Detergent Composition

A laundry detergent composition suitable for use in the present invention comprises: 9.8 wt % clay/silicone agglomerates according to any of examples 6-7; 6.9 wt % anionic surfactant agglomerates according to any of examples 10-11; 59.1 wt % spray dried detergent particle according to example 12; 4.0 wt % clay agglomerates according to any of examples 8-9; 1 wt % alkyl sulphate detersive surfactant condensed with an average of 7 moles of ethylene oxide; 5.1 wt % sodium carbonate; 1.4 wt % tetraacetylyethylenediamine; 7.6 wt % percarbonate; 1.0 wt % perfume; 4.1 wt % miscellaneous/water.

The invention claimed is:

1. A textile treatment composition in particulate form, the composition comprises silicone, clay and anionic surfactant, wherein the composition comprises at least three particulate components:

(i) the first particulate component comprises silicone, clay and a first anionic surfactant;

(ii) the second particulate component comprises from 15% to 80%, by weight of the second particulate component, of a second anionic surfactant and from 15% to 55%, by weight of the second particulate component, of zeolite;

(iii) the third particulate component comprises from 1% to 50%, by weight of the third particulate component, of a third anionic surfactant and from 5% to 40%, by weight of the third particulate component, of sodium carbonate;

wherein the concentration of the second anionic surfactant in the second particulate component is greater than the concentration of the third anionic surfactant in the third particulate component, wherein the first anionic surfactant and the second anionic surfactant are different.

2. A composition according to claim 1, wherein the concentration of the third anionic surfactant in the third particulate component is greater than the concentration of the first anionic surfactant in the first particulate component.

3. A composition according to claim 1, wherein the second particulate component comprises from 25% to 60%, by weight of the second particulate component, of anionic surfactant.

4. A composition according to claim 1, wherein the third particulate component comprises from 5% to less than 25%, by weight of the third particulate component, of anionic surfactant.

5. A composition according to claim 1, wherein the ratio of the concentration of the second anionic surfactant in the second particulate component to the concentration of the third anionic surfactant in the third particulate component is in the range of from 2:1 to 10:1.

6. A composition according to claim 1, wherein the ratio of the weight of third anionic surfactant present in the composition to the weight of second anionic surfactant present in the composition is in the range of from 2:1 to 10:1.

7. A composition according to claim 1, wherein the ratio of the weight of third particulate component present in the composition to the weight of second particulate component present in the composition is in the range of from 2:1 to 20:1.

8. A composition according to claim 1, wherein the composition comprises:

(i) at least 8%, by weight of the composition, of anionic surfactant; and (ii) at least 8%, by weight of the composition, of clay.

9. A composition according to claim 1, wherein the second particulate component is in the form of an agglomerate or an extrudate.

10. A composition according to claim 1, wherein the third particulate is in the form of a spray-dried powder.

* * * * *